US006168387B1

(12) United States Patent
Able et al.

(10) Patent No.: US 6,168,387 B1
(45) Date of Patent: Jan. 2, 2001

(54) RECIPROCATING PUMP WITH LINEAR DISPLACEMENT SENSOR

(75) Inventors: Stephen D. Able, Bryan, OH (US); Joseph L. Meloche, Royal Oak, MI (US); Gordon M. Schroeder, New Bavaria, OH (US)

(73) Assignee: Ingersoll-Rand Company, Woodcliff Lake, NJ (US)

( * ) Notice: Under 35 U.S.C. 154(b), the term of this patent shall be extended for 0 days.

(21) Appl. No.: 09/429,184

(22) Filed: Oct. 28, 1999

(51) Int. Cl.[7] ..... F04B 49/00

(52) U.S. Cl. ..... 417/213; 417/63; 417/47; 417/416; 324/207.16

(58) Field of Search ..... 417/375, 401, 417/63, 213, 46, 47, 416; 324/207.16, 207.22, 207.24

(56) References Cited

U.S. PATENT DOCUMENTS

| | | | | |
|---|---|---|---|---|
| 3,513,408 | | 5/1970 | McGee | 331/65 |
| 3,838,946 | | 10/1974 | Schall | 417/395 |
| 3,848,411 | | 11/1974 | Strawn | 60/432 |
| 4,381,180 | | 4/1983 | Sell | 417/393 |
| 4,512,627 | | 4/1985 | Archer, et al. | 350/96.2 |
| 4,623,840 | | 11/1986 | Fujimura et al. | 324/208 |
| 4,667,158 | | 5/1987 | Redlich | 324/207 |
| 4,674,958 | | 6/1987 | Igarashi et al. | 417/225 |
| 4,717,874 | | 1/1988 | Ichikawa et al. | 324/208 |
| 4,775,301 | | 10/1988 | Cartwright, et al. | 417/417 |
| 4,778,356 | | 10/1988 | Hicks | 417/397 |
| 4,832,582 | | 5/1989 | Buffet | 417/413 |
| 4,854,832 | | 8/1989 | Gardner et al. | 417/393 |
| 4,856,969 | | 8/1989 | Forsythe et al. | 417/395 |
| 4,966,528 | | 10/1990 | Henkel et al. | 417/63 |
| 5,013,223 | | 5/1991 | Takahashi, et al. | 417/413 |
| 5,045,785 | * | 9/1991 | Hansen | 324/207.16 |
| 5,046,702 | * | 9/1991 | Miyazawa et al. | 251/129.04 |
| 5,055,007 | | 10/1991 | Geddings | 417/393 |
| 5,104,298 | | 4/1992 | Takahashi, et al. | 417/415 |
| 5,111,139 | | 5/1992 | Rose | 324/207.22 |
| 5,138,291 | | 8/1992 | Day | 335/258 |
| 5,201,641 | | 4/1993 | Richer | 417/417 |
| 5,232,352 | | 8/1993 | Robinson | 417/393 |
| 5,252,041 | | 10/1993 | Schumack | 417/395 |
| 5,257,914 | | 11/1993 | Reynolds | 417/293 |

(List continued on next page.)

FOREIGN PATENT DOCUMENTS

| | | |
|---|---|---|
| 3347052A1 | 7/1985 | (DE) . |
| 1558206 | 12/1979 | (GB) . |
| 1413408A1 | 7/1988 | (SU) . |

OTHER PUBLICATIONS

Roberts, Howard C., "Electric Gaging Methods for Strain, Movement, Pressure, and Vibration," Instruments, vol. 17, pp. 334–339 (Jun. 1944).

OMEGA Complete Pressure, Strain, and Force Measurement Handbook and Encyclopedia, pp. J–7 to J–12 and J–25 to J–28.

* cited by examiner

*Primary Examiner*—Charles G. Freay
*Assistant Examiner*—Robert Z. Evora
(74) *Attorney, Agent, or Firm*—Leon Nigohosian, Jr.

(57) ABSTRACT

A reciprocating pump having an active feedback system is provided. The reciprocating pump includes a reciprocating pump having a pump chamber with a rod reciprocally movable along a longitudinal axis of the pump chamber, with the rod including a ferromagnetic material. An induction coil disposed around the rod wherein relative axial movement between the inductance coil and the ferromagnetic material of the rod varies the inductance of the induction coil. Also provided is a reciprocating pump having an active feedback system in which the rod has an electrically conductive, diametrically tapered portion. A linear displacement sensor is disposed next to the tapered portion which induces a current in the tapered portion and generates an output voltage proportional to a relative position between the linear displacement sensor and the tapered portion.

8 Claims, 4 Drawing Sheets

U.S. PATENT DOCUMENTS

| | | | |
|---|---|---|---|
| 5,277,555 | 1/1994 | Robinson | 417/393 |
| 5,279,504 | 1/1994 | Williams | 417/393 |
| 5,368,452 | 11/1994 | Johnson et al. | 417/395 |
| 5,378,122 | 1/1995 | Duncan | 417/395 |
| 5,438,261 | 8/1995 | Codina et al. | 324/207.16 |
| 5,499,909 | 3/1996 | Yamada et al. | 417/384 |
| 5,520,523 | 5/1996 | Yorita et al. | 417/387 |
| 5,527,160 | 6/1996 | Kozumplik, Jr. et al. | 417/46 |
| 5,567,118 | 10/1996 | Grgurich et al. | 417/46 |
| 5,616,055 | 4/1997 | Whitehead | 417/46 |
| 5,735,250 * | 4/1998 | Rembold et al. | 123/504 |
| 5,816,778 | 10/1998 | Elsey, Jr. et al. | 417/46 |
| 5,886,617 * | 3/1999 | Meloche et al. | 338/176 |

RECIPROCATING PUMP WITH LINEAR DISPLACEMENT SENSOR

FIELD OF THE INVENTION

This invention generally relates to active feedback devices for air motors and more particularly for reciprocating pumps.

BACKGROUND OF THE INVENTION

Reciprocating pumps are typically utilized to transfer a high viscosity material typically grease or the like from a container such as a drum or barrel to an object of interest which may be a car chassis for example. Such pumps are typically oriented vertically during operation and include a drive motor located outside the container on the container lid, and a reciprocating member operatively connected to the motor to be driven by the motor in a pump chamber. The reciprocating member is placed inside the container and is immersed in the material to be transferred.

During operation of a conventional reciprocating pump, a primer element attached to the reciprocating member is moved with the reciprocating member along a linear axis. The primer element is displaced along the linear axis in a first direction, toward the bottom of the material to be transferred, and is then displaced in a second direction, opposite the first direction, toward the surface of the material to be transferred. As the primer element is displaced in the second direction, it acts like a shovel and pulls the medium into the pump.

Various factors including the dynamics of the fluid being pumped affect the rate of reciprocation of the reciprocating rod. In the case of more viscous fluids, for a given air supply pressure, the reciprocating rod will be caused to reciprocate more slowly thus reducing the output rate of the pump. In attempting to compensate for inequalities between the desired output and the actual output of the pump, passive control systems have been used to measure the pump output and perform some function to increase or decrease the rate of reciprocation of the reciprocating rod. One problem with conventional reciprocating pumps having such passive control systems is that they are not readily controllable except by the introduction of external flow measuring devices which add to the complexity and expense of the pump.

The foregoing illustrates limitations known to exist in present reciprocating pumps. Thus it is apparent that it would be advantageous to provide an alternative directed to overcoming one or more of the limitations set forth above. Accordingly an alternative reciprocating pump having active feedback monitoring is provided including the features more fully disclosed hereinafter.

SUMMARY OF THE INVENTION

According to the present invention, reciprocating pumps having active feedback systems are provided. In a first embodiment, the reciprocating pump includes a reciprocating pump having a housing including a pump chamber. The pump chamber has a rod which is reciprocally movable along a longitudinal axis of the pump chamber and comprises a ferromagnetic material. An induction coil disposed around the rod wherein relative axial movement between the inductance coil and the ferromagnetic material of the rod varies the inductance of the induction coil.

In a second embodiment, a reciprocating pump is provided having an active feedback system in which the rod has an electrically conductive, diametrically tapered portion. A linear displacement sensor is disposed next to the tapered portion which induces a current in the tapered portion and generates an output voltage proportional to a relative position between the linear displacement sensor and the tapered portion.

The foregoing and other aspects will become apparent from the following detailed description of the invention when considered in conjunction with accompanying drawing figures.

BRIEF DESCRIPTION OF THE DRAWING FIGURES

DETAILED DESCRIPTION OF THE PREFERRED EMBODIMENTS

Figure 1:
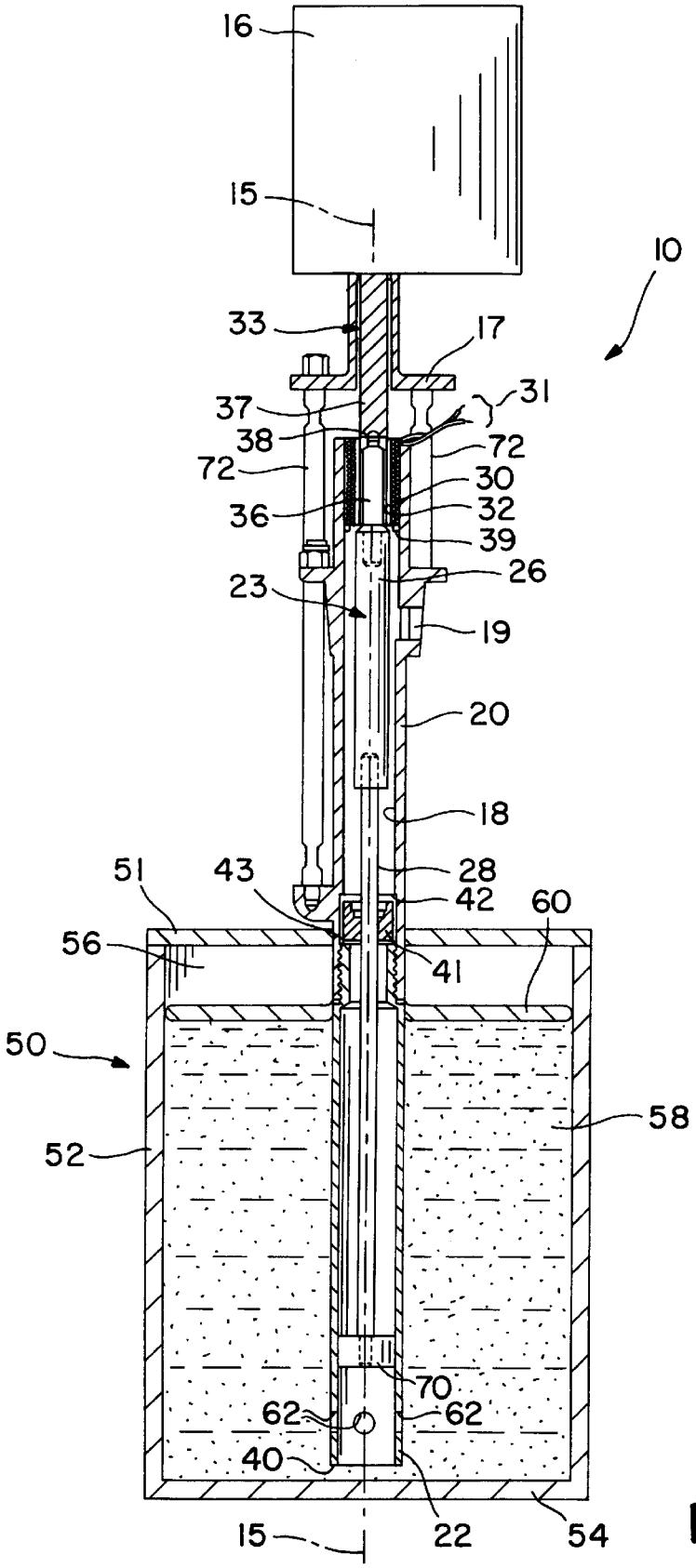
FIG. 1 is a detail side elevation view, partially in section, illustrating a reciprocating pump in a first retracted position and having an active feedback system according to one embodiment of the present invention.

The invention is best understood by reference to the accompanying drawings in which like reference numbers refer to like parts. It is emphasized that, according to common practice, the various dimensions of the component parts shown in the drawings are not to scale and have been enlarged for clarity.

Figure 2:
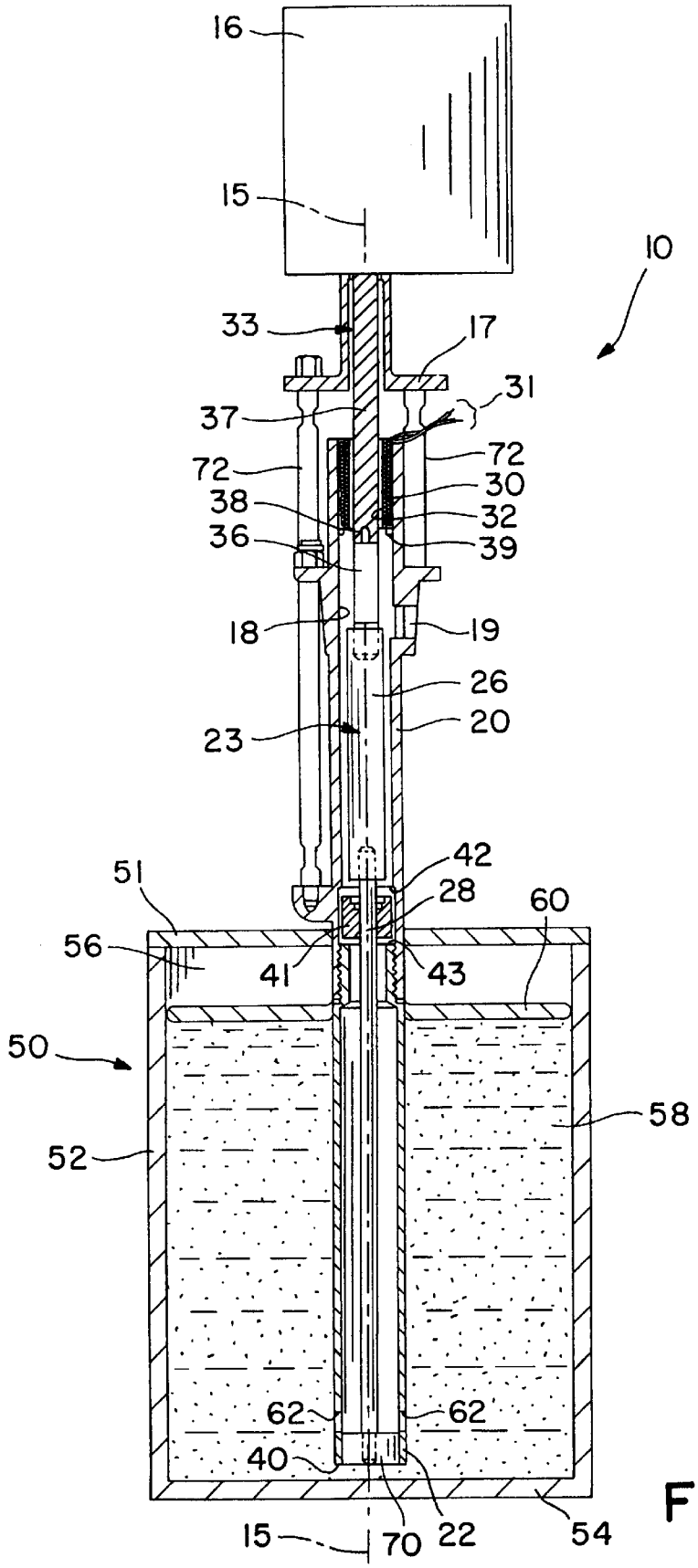
FIG. 2 is a detail side elevation view, partially in section, of the reciprocating pump shown in FIG. 1 in a second, extended position.

Referring now to the drawings, FIGS. 1 and 2 show a reciprocating or piston pump 10 having an active feedback system according to one embodiment of the present invention. Reciprocating pump 10 includes a tubular pump housing 20 containing therein a reciprocating rod 23 which is actuated by a reciprocating drive rod 33 operatively connected to a motor 16. Reciprocating rod 23 is movable in a pump chamber 18 that is defined by the hollow interiors of tubular pump housing 20 and a foot valve 22 connected thereto. Reciprocating rod 23 is movable between a first retracted position shown in FIG. 1 and a second extended position shown in FIG. 2 along axis 15 within tubular pump housing 20. Although the tubular pump housing 20 and foot valve 22 are shown as being cylindrical, their cross-sections may be any suitable shape.

Motor 16 is shown schematically in FIGS. 1 and 2 and may be any motor suitable to move reciprocating drive rod 33 in the manner required. The motor may be a pneumatically driven piston motor having a flange 17 at its lower end and may further be a single-acting or double-acting piston motor well known to one skilled in the art. Air motor 16 is connected to a suitable source of air, e.g., 150 p.s.i., and is adapted to reciprocate the reciprocating drive rod 33 to which it is connected at an upper end of the drive rod.

Motor 16 is adapted to be supported by pump housing 20 which includes a material discharge port 19. Preferably spacer rods 72 connect flange 17 of air motor 16 to tubular pump housing 20. The pump housing in turn is adapted to be supported by the lid 51 of container 50. The container cylindrical sidewall 52 and base 54 define a material storage chamber 56 where material 58 such as grease is stored before it is transferred by pump 10 to an object of interest. The material 58 may be grease as shown in FIGS. 1 and 2 or may be any other highly viscous material such as paint or oil.

The tubular pump housing 20 and foot valve 22 are located in the material storage chamber 56 with foot valve 22 located near base 54. The tubular pump housing 20 and foot valve 22 are immersed in the material 58 when the container is full. A relatively heavy follower plate 60 is seated on the surface of the material 58 and is adapted to be slidable along the length of the tube and foot valve toward container base 54, as the material 58 is transferred out of the container by the pump 10. The follower plate is displaced toward base 54 by gravity and in this way, the material remaining in the container is compacted in the chamber 56 between base 54 and follower plate 60. The clearance between the outer periphery of the follower plate and container sidewall 52 is small so that as the follower plate moves toward the base 54 of the container 50, any material on the sidewall 52 is scraped therefrom by the follower plate.

Tubular pump housing 20 has a first upper end near a material discharge port 19 and a second lower end located in material storage chamber 56. An interior threaded portion is provided along the interior of the second tube end. The threaded portion is adapted to mesh with an external threaded portion of hollow foot valve 22 in the manner shown generally in FIGS. 1 and 2. Foot valve 22 includes an inlet end 40, seat 43, and a plurality of inlet ports 62 spaced circumferentially along the circumference of foot valve 22 at inlet end 40. Material 58 flows into the pump chamber 18 through the inlet ports 62.

A conventional check valve 41 is adapted to move into and out of engagement with seat 43 to thereby intermittently permit material to flow through pump chamber 18, toward discharge port 19, in the manner that will be described in detail hereinbelow. Shoulder 42 limits the distance check valve 41 may be displaced from seat 43.

Reciprocating rod, indicated generally as 23, is comprised of two discrete reciprocating members, a first reciprocating member 26 and a second reciprocating member 28. The members are adapted to move in chamber 18 during operation of pump 10. For purposes of clarity, hereinafter the first reciprocating member 26 may also be referred to as a connection member and the second reciprocating member 28 may be referred to as a primer rod. Primer rod 28 is joined by connection member 26 to reciprocating drive rod 33 driven by motor 16. The members may be joined by any conventional means including a threadable connection or a bolt or other conventional means.

A cylindrical primer element 70 is attached to the lower end of primer rod 28, preferably, by threads but may be connected to the primer rod 28 by any conventional means. Thus, as shown in FIGS. 1 and 2, a continuous fluid flow conduit is defined between the inner wall of pump housing 20 and the outer periphery of reciprocating rod 23. The pump chamber 18 comprises a pumping portion defined by the length of the flow conduit located between a seal 39 disposed in the upper end of housing 20 and the check valve 41 seated in the lower end of tubular pump housing 20. The flow conduit connects the outlet 19 and inlet ports 62, such that the material 58 drawn into the pump is flowed through the continuous conduit.

According to the present invention, active feedback apparatus are provided which anticipate an output condition of a pump by reading and interpreting internal device conditions and performing some function to compensate for inequalities before they occur at the output. This is accomplished by directly and continuously monitoring the position of the reciprocating drive rod at any time during the pump's operation. In reciprocating pumps, because the reciprocating drive rod is linked with the primer element, a change in its position directly represents that of the primer element. Thus, the output of the pump is directly proportional to the movement of the reciprocating drive rod.

Generally, the active feedback apparatus according to the present invention operate by measuring the movement of the reciprocating drive rod. The movement of the reciprocating drive rod is measured in terms of its position (i.e., displacement). The rate of reciprocation (i.e., velocity) or change in the rate of reciprocation (i.e., acceleration) of the reciprocating drive rod can also be derived by measuring the displacement of the reciprocating rod with respect to time.

Shown in FIG. 1 is a first embodiment of the present invention in which a reciprocating pump 10 having a pump housing 20 is provided with an active feedback apparatus having an inductance coil 30 which includes an insulated wire wound about reciprocally movable reciprocating drive rod 33. Inductance coil 30 is disposed around and does not contact reciprocating drive rod 33, and thus does not affect, the motion of the rod. By this design, the non-contact operation of the inductance coil provides an added inherent benefit of virtually infinite life.

Inductance coil 30 may be manufactured from any electrically conductive wire which is externally insulated. Preferably, the conductive wire is a copper wire or "music wire." Music wire is a high carbon, low alloy steel with a smooth finish and typically having a gauge of 25 to 32. As will become apparent to those skilled in the art, the dimensions of the inductance coil are dependent upon the diameter and stroke of the reciprocating drive rod.

Inductance coil 30 is connected via leads 31 to a standard LC-type oscillator (not shown) that produces a sinusoidal waveform (i.e., one having an amplitude change as a sine function such as alternating current). In response to the inductance of the inductance coil 30, the alternating current produces a position signal that is representative of the linear position of the reciprocating drive rod relative to the inductance coil as described in greater detail below. A suitable oscillator may include a Colpitts oscillator, which is well known in the art.

Reciprocating drive rod 33 includes a ferromagnetic material such that relative axial movement between inductance coil 30 and the ferromagnetic material of reciprocating drive rod 33 varies the inductance of the coil. Reciprocating drive rod 33 reciprocates within a reciprocation section 32 that is preferably a cylinder that is located within tubular pump housing 20 as shown. Preferably, reciprocation section 32 is made of an electrically insulating material to electrically isolate the inductance coil from the reciprocating drive rod. Alternately, reciprocating drive rod 33 may be coated with an epoxy to electrically isolate the inductance coil 30 from the reciprocating drive rod 33. For example, a suitable coating may include an epoxy resin manufactured by Dow Chemicals of Midland, Mich., as product no. DER331 mixed with a polysebasic polyanhydride (PSPA) manufactured by Cambridge Industries of America of Newark, N.J. However, any other suitable non-conductive coating may be used.

Preferably, reciprocating drive rod 33 is formed of two connected halves of different materials, a ferromagnetic half 36 and a non-ferromagnetic half 37. Ferromagnetic half 36 is made from a material which can be attracted magnetically and, preferably, is made of iron or nickel. Non-ferromagnetic half 37 is made of a material which cannot be attracted magnetically and, preferably, is made of stainless steel or plastic. Ferromagnetic half 36 and non-ferromagnetic half 37 are connected, preferably, by a threaded fastener 38. By this construction, upon moving reciprocating drive rod 33 within reciprocation section 32 as shown in FIGS. 1–2 and described in greater detail below, the movement of the non-ferrous metal alone within inductance coil does not affect the resultant impedance of the coil.

Referring now to the drawings, operation of reciprocating pump 10 will now be described. Shown in FIGS. 1–2 is a cross-sectional schematic that illustrates the motion of a reciprocating drive rod 33 and reciprocating rod 23 as they move through successive stages of a pumping stroke within the pumping chamber 18 of reciprocating pump 10. Motor 16, through reciprocating drive rod 33, moves the reciprocating rod 23 and primer element 70 in pump chamber 18 between the retracted position shown in FIG. 1 and the extended position shown in FIG. 2. When the reciprocating means and element are displaced from the retracted position to the extended position, material 58 is forced out of the foot valve inlet end 40 and is mixed with the volume of material 58 stored in chamber 56.

As the primer element 70 is moved downward past inlet ports 62 to the extended position, material 58 enters pump chamber 18 through inlet ports 62. Check valve 41 is seated against seat 43 as the primer element 70 and reciprocating rod 23 are moved to the extended position by the motor 16.

When at the fully extended position shown in FIG. 2, primer element 70 is located between inlet ports 62 and inlet end 40. Motor 16 then moves reciprocating rod 23 and primer element 70 along axis 15 to the retracted position. As the primer element is moved toward the retracted position, the primer acts like a shovel and forces the material 58 that was previously flowed into the chamber through the inlet ports, toward the discharge port 19. The upward displacement of the material forces the check valve 41 off the seat 43 and permits the material to flow past the valve.

The reciprocating motion is repeated rapidly to transfer material from the container 50. Thus, the reciprocating pump accomplishes a nearly constant flow of pumping through the pump by continuously driving the reciprocating rod back and forth in the pump.

In operation, when the interface between the ferromagnetic half 36 and non-ferromagnetic half 37 of reciprocating drive rod 33 travels upward to the position shown in FIG. 2A, the amount of ferromagnetic material inside the inductance coil increases. This, in turn, increases the impedance of the inductance coil thereby causing the current drawn to be reduced. Bridge processing circuitry (not shown) such as that described in U.S. Pat. No. 4,667,158, the disclosure of which is herein incorporated by reference, is used to detect the amount of current drawn and, from this, determine the incremental linear position of the rod relative to pump housing 20. Conversely, in moving reciprocating drive rod 33 downward to the extended position shown in FIG. 2, the amount of ferromagnetic material in inductance coil 30 decreases thereby decreasing the impedance of the coil and causing the current drawn, which is detected by the bridge processing circuitry described above, to be increased. Between the positions shown in FIGS. 1 and 2, when the interface between the ferromagnetic half 36 and the non-ferromagnetic half 37 is centered within inductance coil 30, a median impedance is produced in inductance coil 30.

Thus, to summarize, by moving the ferromagnetic half of reciprocating drive rod 33 into inductance coil 30, the mass of ferromagnetic material in inductance coil 30 changes as the reciprocating drive rod moves. This, in turn, changes the inductance coil impedance with the impedance increasing proportionally to the amount of the ferromagnetic half contained within the coil. In this manner, the inductance coil 30 may be used as a variable inductor in a resonant circuit to determine the position of reciprocating drive rod 33 from the inductance of the coil.

Figure 3:
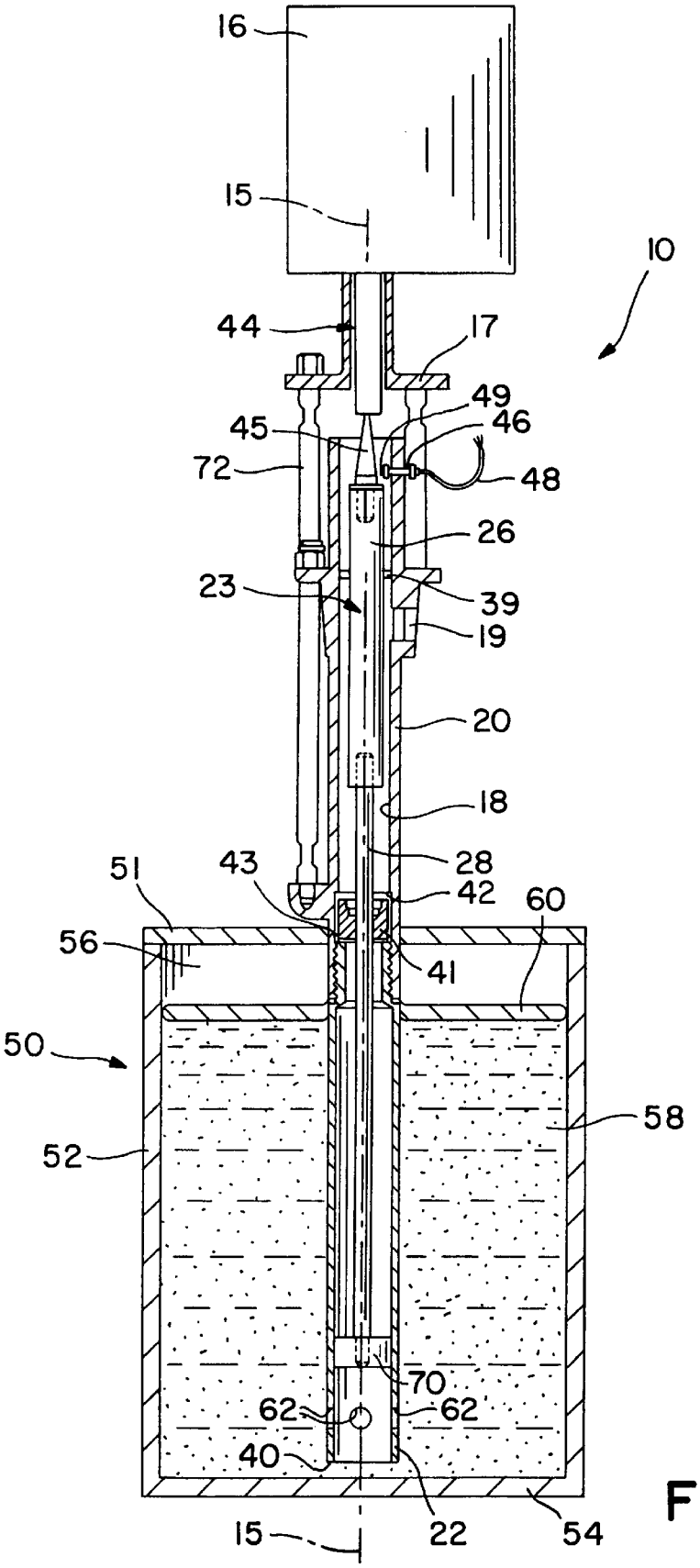
FIG. 3 is a detail side elevation view, partially in section, illustrating a reciprocating pump in a first retracted position and having an active feedback system according to an alternate embodiment of the present invention.
Figure 4:
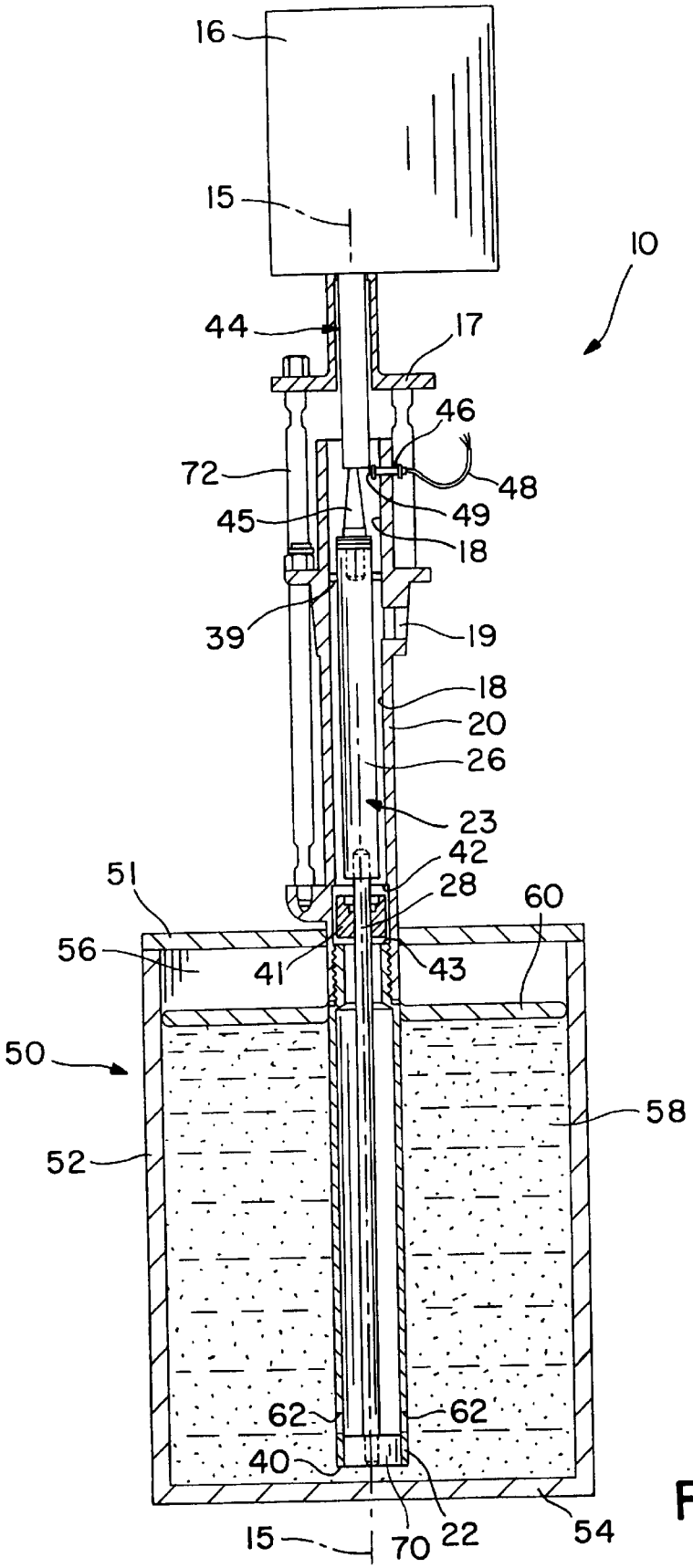
FIG. 4 is a detail side elevation view, partially in section, of the reciprocating pump shown in FIG. 3 in a second, extended position.

According to another embodiment of the present invention, shown in FIGS. 3–4 is a cross-sectional schematic that illustrates the motion of a reciprocating drive rod 44 in a piston pump similar to that shown in FIGS. 1 and 2 which incorporates a linear displacement sensor 46 with the following additional modifications. Located along a reciprocating drive rod 44 is a diametrically tapered portion 45 made of an electrically conductive material. Linear displacement sensor 46 is located in pump housing 20 as shown and mounted perpendicular to the reciprocating drive rod 44 so that throughout the drive rod's range of motion, it is adjacent to a face 49 of sensor 46.

In operation, when reciprocating drive rod 44 travels upward to the position shown in FIG. 3, the taper decreases the distance between face 49 of linear displacement sensor 46 and reciprocating drive rod 44. As described in greater detail below, this causes the sensor to produce a lower voltage output. Conversely, as reciprocating drive rod 44 shifts downward to the position shown in FIG. 4, the taper increases the gap with face 49 thereby increasing the voltage output of linear displacement sensor 46. Between the positions shown in FIGS. 3 and 4, when linear displacement sensor 46 is centered along tapered portion 45, a median voltage is produced.

Preferably, linear displacement sensor 46 is a non-contact sensor which uses a magnetic field (also known as an eddy-current field) across face 49 to induce a current in a metal piece placed in the magnetic field. By measuring the power loss caused by the current induced in the metal piece, the proximity of the metal piece with respect to face 49 can be determined. Preferably, a non-contact linear displacement sensor having an analog output such as a LD701 Series sensor available from Omega Engineering Inc., Stamford, Conn. is used to determine the position of reciprocating drive rod 44 based upon the output voltage detected. By this design, the non-contact operation of the linear displacement sensor provides an added inherent benefit of virtually infinite life.

Preferably, when using an OMEGA LD701 Series linear displacement sensor, electrically conductive tapered portion 45 is manufactured using a mild steel, a stainless steel, brass aluminum, or copper. When using an OMEGA LD701 Series linear displacement sensor in this fashion, by providing a 14–30 Vdc, 20 mA excitation voltage to leads 48, a magnetic field is provided across face 49.

As shown in FIGS. 3–4, linear displacement sensor 46 is aligned so that it is aligned with a midpoint of tapered portion 45 when reciprocating drive rod 44 is at a midpoint of a reciprocating stroke. Using this configuration, upon moving reciprocating drive rod 44 sequentially from the position shown in FIG. 3 to FIG. 4, typical output voltages ranging from 1–9 volts, respectively, are obtained which correlate with the position of tapered reciprocating drive rod 44. These output voltages are inputted via leads 48 to a controller or computer device (not shown) which then determines the position of reciprocating drive rod 44 from the voltage signal and can perform additional signal processing and control functions. Although linear displacement sensor 46 is shown as being aligned with the midpoint in tapered portion 45, it will be readily recognized to those skilled in the art that the location of linear displacement sensor 46 may be varied with respect to its position along the tapered portion to achieve a corresponding output position signal which is shifted.

The resultant position signals produced by both the inductance coil and the displacement sensors described above are analog and therefore have infinite resolution such that they can be easily converted into a control signal for the pump device using electronic signal processing devices and techniques known in the art. In this fashion, all elements of an analog position signal can thus be used to determine instantaneous position, velocity, and acceleration of the reciprocating rod thus control the pump accordingly. The inductance coil and displacement sensors described above also provide the advantage that they do not contact the reciprocating drive rod and therefore do not wear the rod or otherwise impede its motion.

Although described above with respect to using a particular displacement sensors, it will become readily apparent that other displacement sensors which convert the distance between its sensing face and a moving object to an electronic signal may be utilized.

An important advantage provided by the active feedback apparatus according to the present invention is that by sensing the exact position of a reciprocating rod as a function of time, a more accurate means for accurately measuring the actual displacement of the rod in real time is provided. For example, the sensing a sudden change in velocity in mid-travel of the reciprocating rod could be used to detect a cavitation problem.

Moreover, based upon the information received using the active control devices according to the present invention, corrective action may also be implemented. For example, it is normal for reciprocating rods in reciprocating pumps to over-travel after the mechanical switching device has been switched. The amount of overtravel will vary, however, with the speed of operation due to the momentum of the reciprocating rod and the time it takes for the mechanical shifting device to effect the reversal of the motion of the reciprocating rod. By using active control feedback provided by the present invention, the amount of overtravel can be detected and compensated for in real time by using a computer controller.

Thus, based upon the information provided using the active sensing devices according to the present invention by themselves or when used in conjunction with additional sensors (e.g., pressure transducers or thermocouples) various abnormal conditions may be diagnosed and corrected.

Thus, according to the present invention active feedback apparatus are provided which, by the introduction of sensors and minor modifications to existing reciprocating pump components, produce an output signal proportional to the position of a reciprocating pump reciprocating drive rod. Additional benefits are realized by virtue of the minor nature of the component modifications which facilitate the retrofitting of existing pumps to allow field conversion. Moreover, the analog output signal produced by the active feedback apparatus is very versatile and easily converted to permit diagnostic and control functions to be performed on a pump.

While embodiments and applications of this invention have been shown and described, it will be apparent to those skilled in the art that many more modifications are possible without departing from the inventive concepts herein described. For example, although the present invention is shown and described above with respect to monitoring the volumetric displacement of a reciprocating pump, various other output parameters may be anticipated by reading and interpreting internal device conditions by monitoring the reciprocating rod position. For example, actual dispensing/metering control, stall prevention, noise suppression, etc. may be actively compensated for by reading the position of the reciprocating rod and performing some function to compensate before they occur at the output.

It is understood, therefore, that the invention is capable of modification and therefore is not to be limited to the precise details set forth. Rather, various modifications may be made in the details within the scope and range of equivalents of the claims without departing from the spirit of the invention.

What is claimed is:

1. A reciprocating pump comprising:

a reciprocating pump having a housing including a pump chamber having a rod reciprocally movable along a longitudinal axis of said pumping chamber, said rod having an electrically conductive, diametrically tapered portion; and a linear displacement sensor disposed next to said tapered portion which induces a current in said tapered portion and generates an output voltage proportional to a relative position between said linear displacement sensor and said tapered portion.

2. The reciprocating pump as recited in claim 1 wherein said rod is a reciprocating drive rod driven by an air motor of said pump.

3. The reciprocating pump as recited in claim 2 wherein said reciprocating drive rod is connected to and reciprocally drives a primer rod having a primer element.

4. The reciprocating pump as recited in claim 3 wherein said linear displacement sensor is a non-contact OMEGA LD701 Series sensor.

5. The reciprocating pump as recited in claim 2 wherein said linear displacement sensor is a non-contact OMEGA LD701 Series sensor.

6. The reciprocating pump as recited in claim 1 wherein said linear displacement sensor is aligned with a midpoint of said tapered portion when said rod is at a midpoint of a reciprocating stroke.

7. The reciprocating pump as recited in claim 6 wherein said linear displacement sensor is a non-contact OMEGA LD701 Series sensor.

8. The reciprocating pump as recited in claim 1 wherein said linear displacement sensor is a non-contact OMEGA LD701 Series sensor.

* * * * *